US010012946B2

(12) United States Patent
Maeda

(10) Patent No.: US 10,012,946 B2
(45) **Date of Patent: *Jul. 3, 2018**

(54) IMAGE FORMING APPARATUS, LOCK DEVICE, LOCK UNIT

(71) Applicant: KYOCERA Document Solutions Inc., Osaka-shi, Osaka (JP)

(72) Inventor: Hiroyuki Maeda, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/495,780

(22) Filed: Apr. 24, 2017

(65) Prior Publication Data

US 2017/0315499 A1 Nov. 2, 2017

(30) Foreign Application Priority Data

Apr. 27, 2016 (JP) ..... 2016-089876

(51) Int. Cl.
*G03G 21/16* (2006.01)

(52) U.S. Cl.
CPC ..... *G03G 21/1647* (2013.01); *G03G 21/1676* (2013.01)

(58) Field of Classification Search
CPC ..... G03G 21/1842
See application file for complete search history.

(56) References Cited

U.S. PATENT DOCUMENTS

2011/0058825 A1* 3/2011 Tsukijima ..... G03G 21/1633 399/27
2015/0084272 A1* 3/2015 Maruyama ..... G03G 15/6529 271/226
2016/0187839 A1* 6/2016 Ueyama ..... G03G 21/1633 399/110

FOREIGN PATENT DOCUMENTS

JP 2006301071 A 11/2006

* cited by examiner

*Primary Examiner* — Victor Verbitsky
(74) *Attorney, Agent, or Firm* — Alleman Hall Creasman & Tuttle LLP

(57) ABSTRACT

A lock device includes a lock cover, a restricting portion, a drive source, a biasing portion, and a pressing portion. The lock cover is opened and closed when a developer storing portion storing developer is attached or detached. The restricting portion, when the lock cover is closed, is engaged with the lock cover in such a way as to restrict the lock cover from being opened. The drive source drives the restricting portion in such a way as to release an engagement between the restricting portion and the lock cover. The biasing portion biases the restricting portion in a direction opposite to a direction in which the drive source drives the restricting portion. The pressing portion presses the lock cover in an opening direction in conjunction with an operation of the drive source to release the engagement between the restricting portion and the lock cover.

6 Claims, 12 Drawing Sheets

IMAGE FORMING APPARATUS, LOCK DEVICE, LOCK UNIT

INCORPORATION BY REFERENCE

This application is based upon and claims the benefit of priority from the corresponding Japanese Patent Application No. 2016-089876 filed on Apr. 27, 2016, the entire contents of which are incorporated herein by reference.

BACKGROUND

The present disclosure relates to an image forming apparatus for forming an image by using developer, and to a lock device and a lock unit for use in the same.

An electrophotographic image forming apparatus is configured such that a developer storing portion storing developer such as toner can be attached thereto in a detachable manner. In an image forming process executed in the image forming apparatus, an image is formed on a sheet by using developer supplied from the developer storing portion. It is noted that this type of image forming apparatus is provided with a cover that is opened and closed when the developer storing portion is attached or detached.

SUMMARY

A lock device according to an aspect of the present disclosure includes a lock cover, a restricting portion, a drive source, a biasing portion, and a pressing portion. The lock cover is opened and closed when a developer storing portion storing developer is attached or detached. The restricting portion, when the lock cover is closed, is engaged with the lock cover in such a way as to restrict the lock cover from being opened. The drive source drives the restricting portion in such a way as to release an engagement between the restricting portion and the lock cover. The biasing portion biases the restricting portion in a direction opposite to a direction in which the drive source drives the restricting portion. The pressing portion presses the lock cover in an opening direction in conjunction with an operation of the drive source to release the engagement between the restricting portion and the lock cover.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

Figure 1:
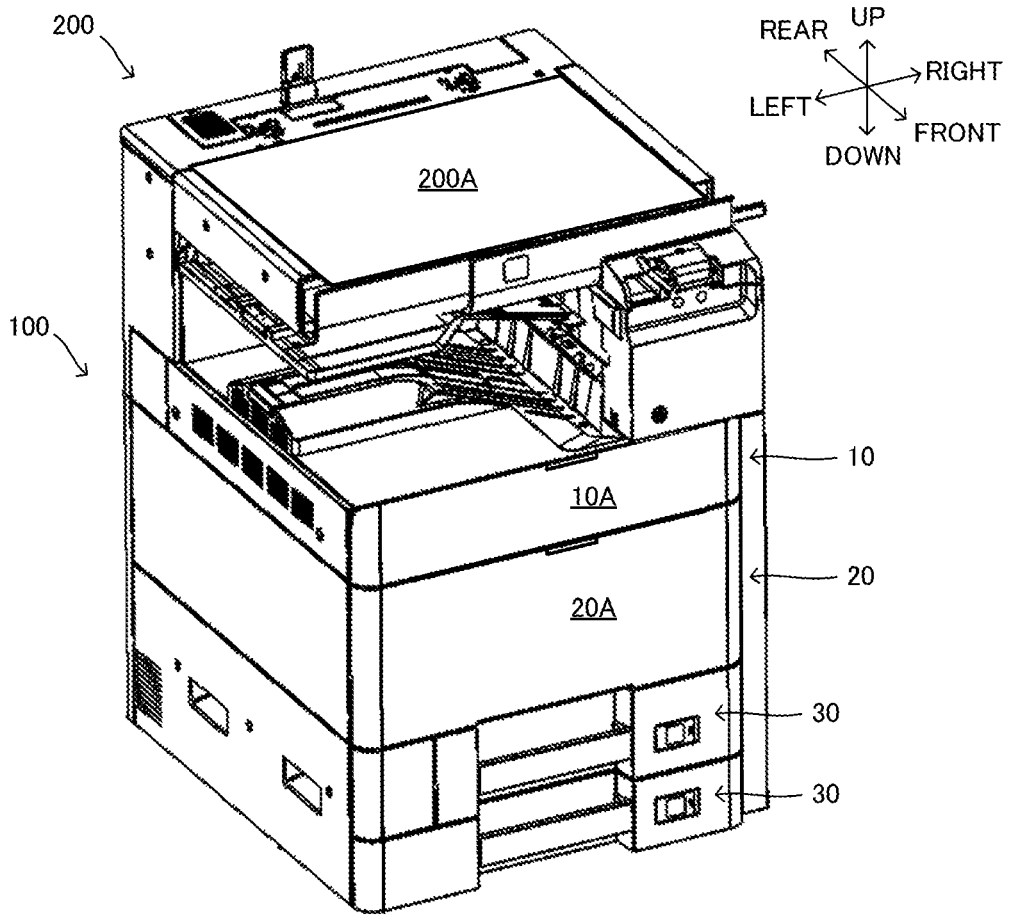
FIG. 1 is a diagram showing a configuration of an image forming apparatus according to an embodiment of the present disclosure.

As shown in FIG. 1, a multifunction peripheral according to the present embodiment includes an image forming apparatus 100 and an image reading device 200. The image reading device 200 is mounted on an upper portion of the image forming apparatus 100 and configured to read image data from a document sheet placed on a document sheet table 200A by using an imaging element such as CCD. It is noted that the image forming apparatus 100 according to the present disclosure may be a printer on which the image reading device 200 is not mounted.

The image forming apparatus 100 is a color printer including a container housing portion 10, an image forming portion 20, and sheet feed cassettes 30. A plurality of developer storing portions 101 are individually attached to the container housing portion 10 in a detachable manner, wherein the plurality of developer storing portions 101 respectively store developer including toner of a plurality of colors (see FIG. 4).

In addition, front covers 10A and 20A that can be opened and closed are respectively provided on the front sides of the container housing portion 10 and the image forming portion 20. It is noted that the image forming apparatus 100 includes an open/close detecting portion 10B configured to detect whether the front cover 10A is opened or closed, wherein the open/close detecting portion 10B is an optical sensor, for example (see FIG. 2).

As one example, a lower-end portion of each of the front cover 10A and the front cover 20A is pivotally supported by a pivoting shaft that is parallel to the left-right direction. That is, the front cover 10A and the front cover 20A are opened, with the upper portions thereof pivoting frontward. The sheet feed cassettes 30 are attached to the image forming apparatus 100 individually in a detachable manner. Sheets such as sheets of paper on which images are to be formed, are stored in the sheet feed cassettes 30.

Figure 2:
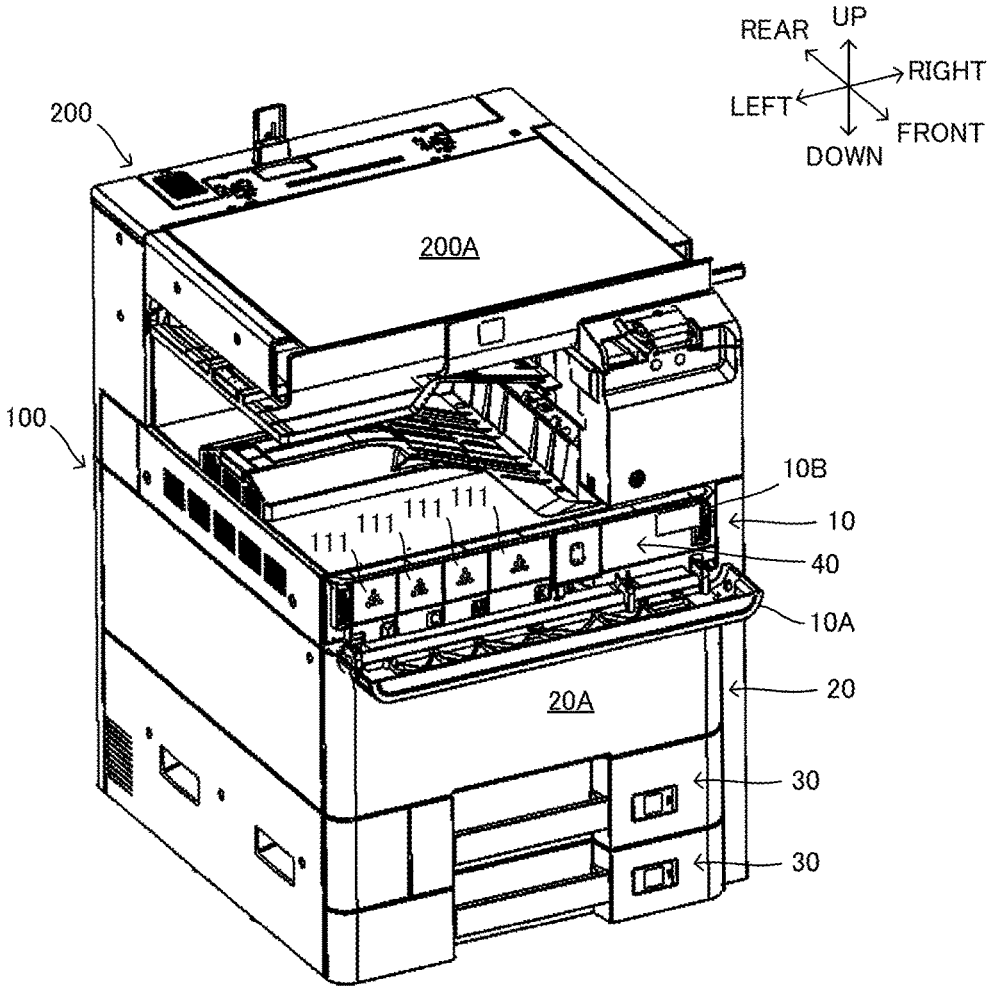
FIG. 2 is a diagram showing a configuration of the image forming apparatus according to the embodiment.

FIG. 2 shows a state where the front cover 10A is opened. The container housing portion 10 includes a lock unit 40 that is configured to switch between a state where the developer storing portions 101 storing developer such as toner can be attached or detached, and a state where the developer storing portions 101 cannot be attached or detached.

The lock unit 40 is an option unit that is attached to the container housing portion 10 of the image forming apparatus 100 in a detachable manner. The lock unit 40 includes a plurality of lock devices 11 (see FIG. 5 and FIG. 6) that correspond to the plurality of developer storing portions 101. In the lock devices 11, lock covers 111 that correspond to the developer storing portions 101 storing developer of a plurality of colors, can be opened and closed individually. Each of the lock covers 111 is opened and closed when the corresponding developer storing portion 101 is attached or detached.

Figure 3:
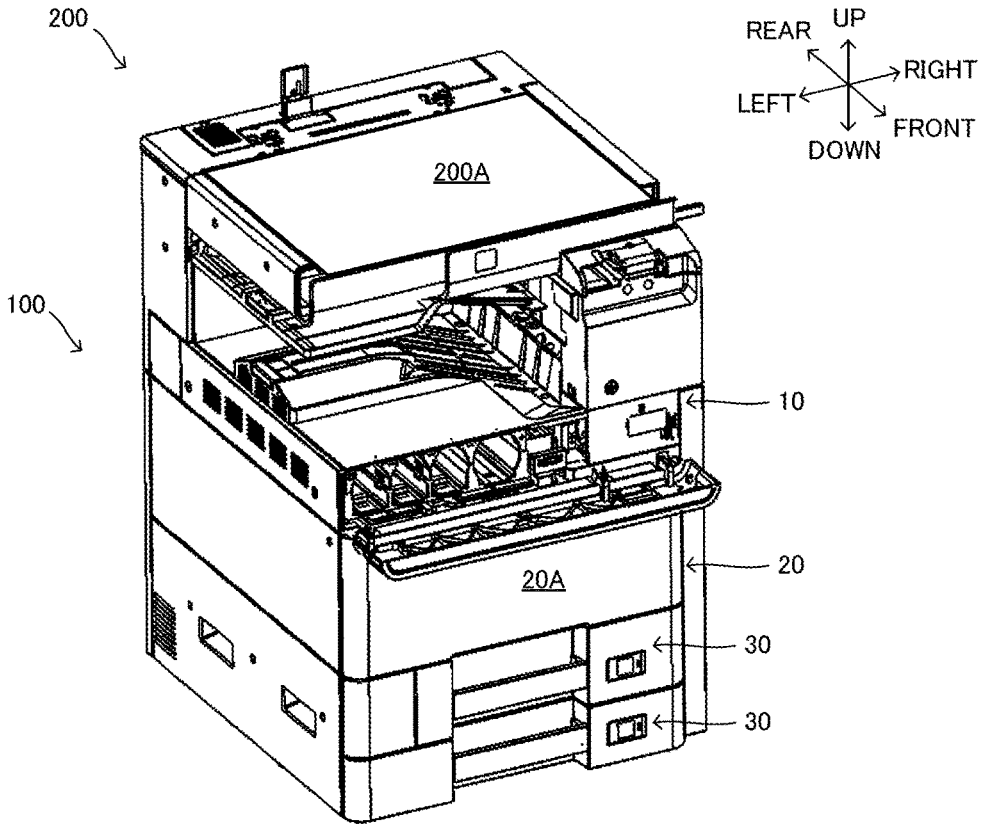
FIG. 3 is a diagram showing a configuration of the image forming apparatus according to the embodiment.

In addition, each of the lock devices 11 is configured to switch between a state where opening a corresponding lock cover 111 is restricted, and a state where opening the corresponding lock cover 111 is not restricted. The lock unit 40 is described in details below. It is noted that FIG. 3 shows a state where the lock unit 40 has been removed. In the image forming apparatus 100, the developer storing portions 101 can be attached and detached and used even in a state where the lock unit 40 is not attached.

Figure 4:
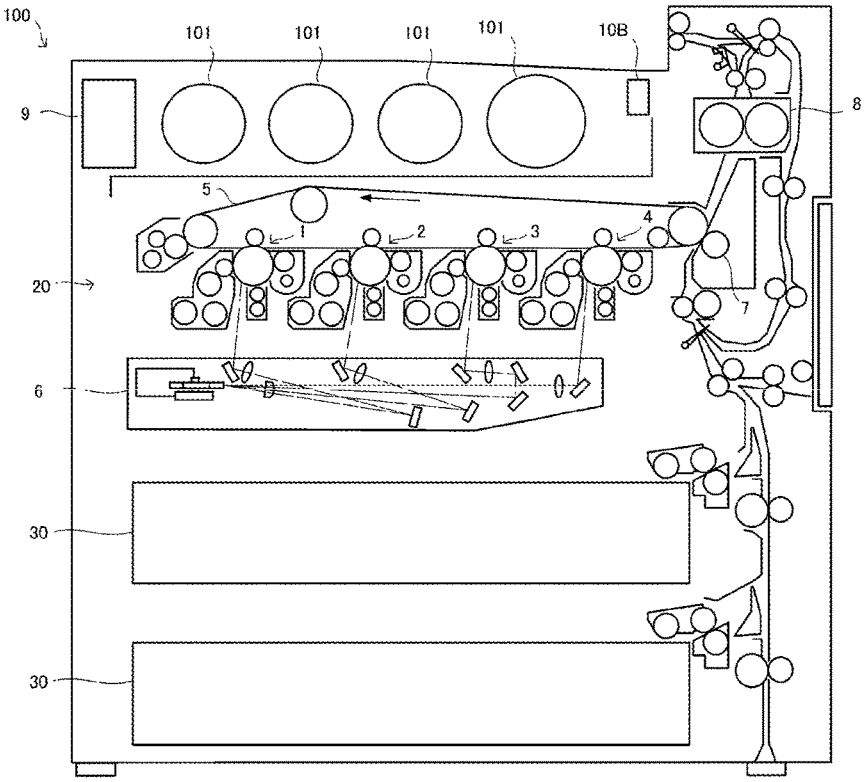
FIG. 4 is a diagram showing a configuration of the image forming apparatus according to the embodiment.

As shown in FIG. 4, the image forming portion 20 includes a plurality of image forming units 1 to 4, an intermediate transfer belt 5, a laser scanning device 6, a secondary transfer device 7, and a fixing device 8. The image forming portion 20 can form a monochrome or color image on a sheet, such as a sheet of paper, supplied from the sheet feed cassettes 30, by using the developer stored in the developer storing portions 101.

Each of the image forming units 1 to 4 includes a photoconductor drum (image-carrying member), a charging device, a developing device, a primary transfer device, and a drum cleaning device and forms an image by using the developer stored in the developer storing portions 101 by the electrophotography method. The image forming units 1 to 4 are aligned along a running direction of the intermediate transfer belt 5 and constitute the image forming portion 20 of a so-called tandem type. To the developing devices of the image forming units 1 to 4, developer of colors Y, M, C and K is supplied from the developer storing portions 101.

The image forming apparatus 100 includes a control portion 9 that includes a CPU, a ROM and a RAM, and controls the image forming apparatus 100 and the image reading device 200. Specifically, the control portion 9 detects the remaining amount or used amount of developer with regard to the developer stored in each of the developer storing portions 101, and when the remaining amount or used amount of developer has reached a predetermined threshold, the control portion 9 informs, on a display portion (not shown) or the like, a developer remaining amount reduction error. The remaining amount or used amount of developer can be detected, for example, from a detection result of an optical sensor or a weight sensor, or from a result of calculation based on the number of prints or the printing rate. It is noted that the control portion 9 detecting the remaining amount or used amount of developer in the developer storing portions 101 is an example of the developer detecting portion.

In addition, as described above, the control portion 9 performs a lock control process for, in the lock devices 11 described below, arbitrarily switching between a state where any arbitrary lock covers 111 are opened, and a state where any arbitrary lock covers 111 are restricted from being opened. Specifically, in the lock control process, the control portion 9 locks a lock cover 111 that corresponds to a developer storing portion 101 whose developer remaining amount has not reached the threshold, and unlocks a lock cover 111 that corresponds to a developer storing portion 101 whose developer remaining amount has reached the threshold.

More specifically, in the present embodiment, when the open/close detecting portion 10B detects an opening of the front cover 10A in a state where the remaining amount or used amount of developer of any of the developer storing portions 101 has reached the threshold, the control portion 9 unlocks a lock cover 111 corresponding to that developer storing portion 101. At this time, among the plurality of lock covers 111, only the lock cover 111 that corresponds to the developer storing portion 101 whose remaining amount or used amount of developer has reached the threshold, is unlocked.

With this configuration, when the user opens the front cover 10A, only the lock cover 111 among the plurality of lock covers 111 that corresponds to the developer storing portion 101 which needs to be replaced, is unlocked. It is accordingly possible to prevent a wasteful replacement of a developer storing portion 101 which needs not be replaced since the remaining amount or used amount of developer thereof has not reached the threshold. It is noted that the condition for unlocking a lock cover 111 is not limited to this.

Next, the lock unit 40 is described with reference to FIG. 5 to FIG. 13.

Figure 5:
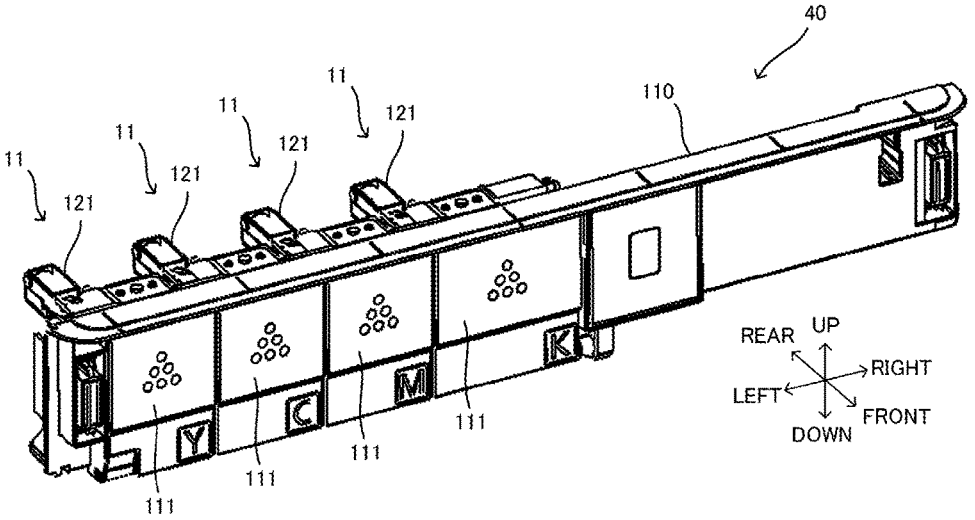
FIG. 5 is a diagram showing a configuration of a lock unit according to the embodiment.
Figure 6:
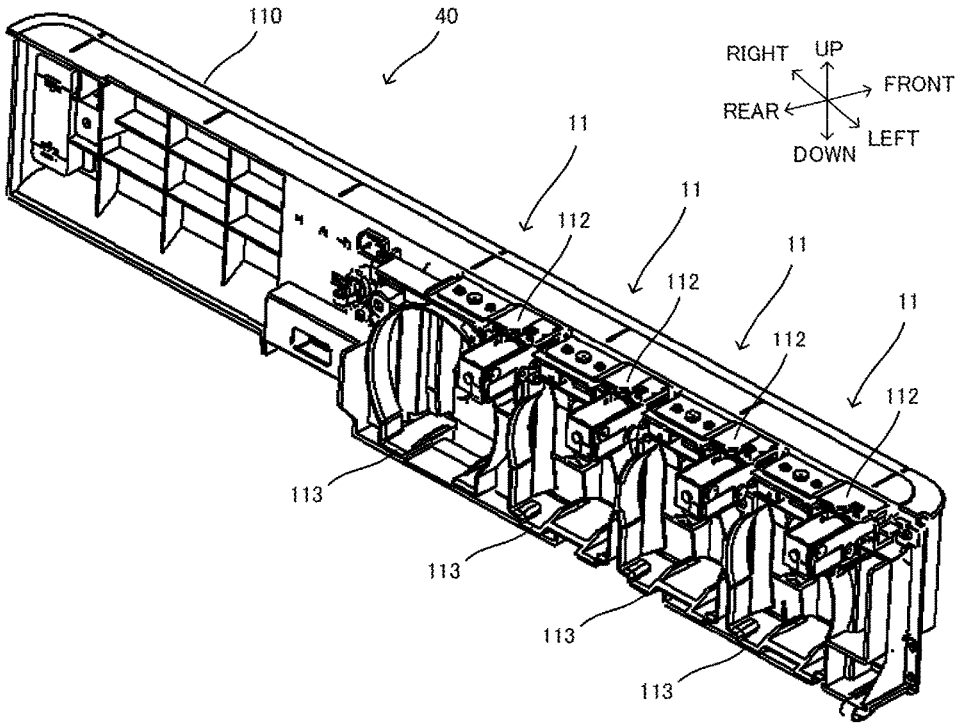
FIG. 6 is a diagram showing a configuration of the lock unit according to the embodiment.

As shown in FIG. 5 and FIG. 6, the lock unit 40 includes four lock devices 11. Each of the lock devices 11 includes a lock cover 111, a lock mechanism 112, and an insertion portion 113.

A lower-end portion of the lock cover 111 is pivotally supported by a pivoting shaft that is parallel to the left-right direction, the pivoting shaft being supported by the housing 110 of the lock unit 40. That is, as is the case with the front cover 10A of the container housing portion 10, the lock cover 111 is opened, with the upper portion of the lock cover 111 pivoting frontward.

The lock mechanism 112 can restrict a corresponding lock cover 111 from being opened. The insertion portion 113 has an opening through which the developer storing portion 101 is inserted into and pulled out from the container housing portion 10, and the opening is opened and closed by the lock cover 111. That is, in each of the lock devices 11, when the lock cover 111 is locked by the lock mechanism 112, the attachment/detachment of the developer storing portion 101 to/from the container housing portion 10 is restricted by the lock cover 111.

Meanwhile, in the image forming apparatus 100, when the user needs to perform a work of opening a lock cover 111 corresponding to a work-target developer storing portion 101, the work is troublesome to the user. In addition, in the case where a plurality of lock covers 111 are included in the lock unit 40 in correspondence with the plurality of developer storing portions 101, it is necessary to identify and open, among the plurality of lock covers 111, a lock cover 111 that corresponds to the work-target developer storing portion 101. On the other hand, in the image forming apparatus 100, the trouble of opening and closing the lock cover 111 to attach or detach the developer storing portions 101 is eliminated.

FIG. 7 to FIG. 10 are each a cross-sectional view showing a main part of the lock device 11 viewed from above. In addition, FIG. 11 is a schematic diagram of the lock device 11 viewed from left, wherein a fixing portion 110A and the like are omitted for the sake of convenience. It is noted that since the four lock devices 11 corresponding to the four developer storing portions 101 have the same configuration, only one lock device 11 is described in the following.

Figure 7:
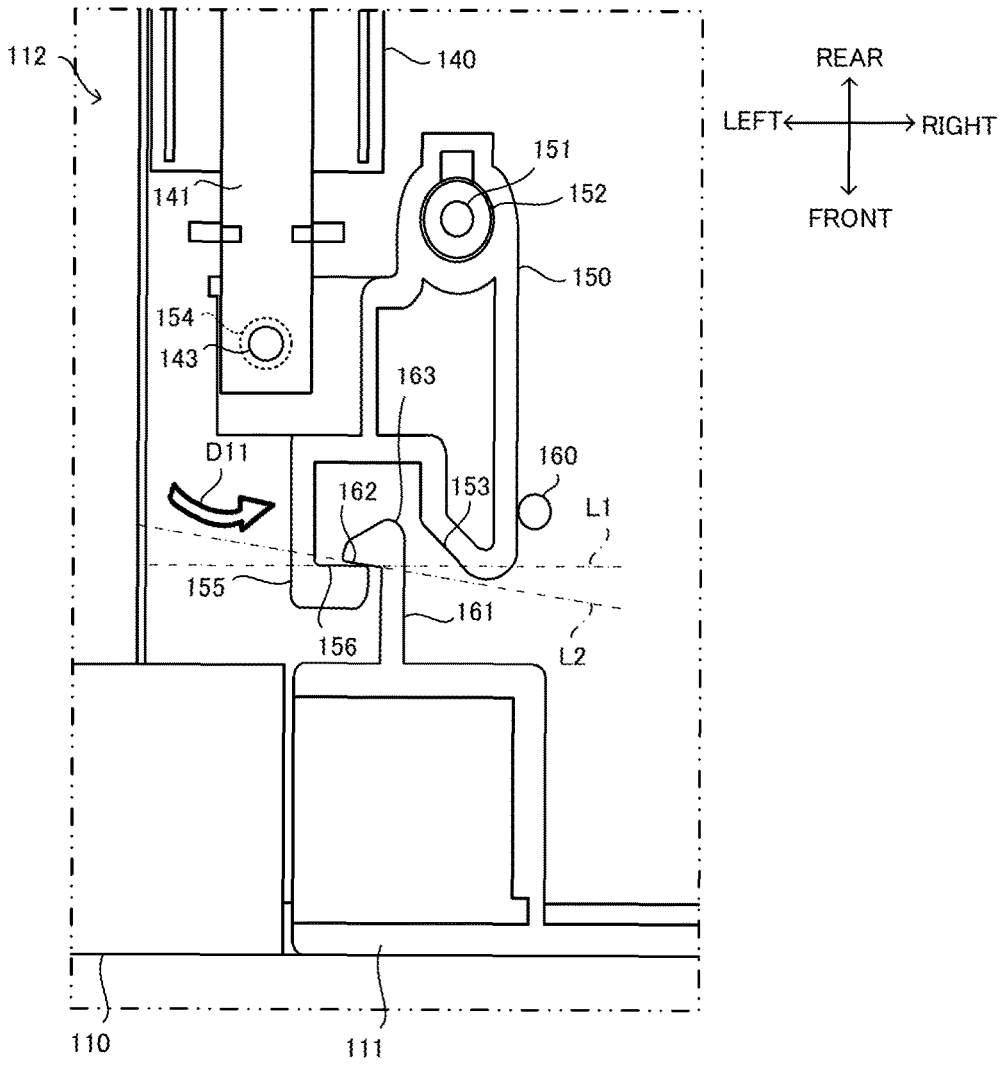
FIG. 7 is a diagram showing a configuration of a lock device according to the embodiment.

As shown in FIG. 7, the lock mechanism 112 includes a drive source 140, a restricting portion 150, and a regulating portion 160. In the lock device 11, when the lock cover 111 is closed, the lock cover 111 is restricted by the lock mechanism 112 from being opened, and when the restricting portion 150 is driven by the drive source 140, the restriction by the lock mechanism 112 is released and the lock cover 111 is opened (see FIG. 11).

Specifically, the lock cover 111 includes an engaging portion 161 that has a shape of letter "L" and projects from an upper portion of the lock cover 111 toward the rear side. The engaging portion 161 has a contact surface 162 such that an angle inside the L-shape portion is greater than at least 90 degrees. In addition, in the engaging portion 161, a tip portion 163 of an arc shape is formed outside a corner of the L-shape portion. It is noted that the restricting portion 150 and the lock cover 111 are, for example, molded by a resin material.

On the other hand, the drive source 140 of the lock mechanism 112 is a solenoid that, in response to energization, suck and draw a movable portion 141 in a suction direction D21 (an example of the predetermined direction) directed to the inside of the apparatus. The drive source 140 is fixed to a fixing portion 110A that projects from the housing 110 of the lock devices 11 toward the rear side. In addition, as shown in FIG. 11 and the like, a cutout 142 is formed in the tip of the movable portion 141. When, in a state where the restricting portion 150 is inserted in the cutout 142, a shaft portion 143 is attached to the movable portion 141 so as to pierce the movable portion 141 and the restricting portion 150, the movable portion 141 is coupled with the restricting portion 150.

When the lock cover 111 is closed, the restricting portion 150 is engaged with the lock cover 111 and restricts the lock cover 111 from being opened. In addition, the engagement between the restricting portion 150 and the lock cover 111 is released when the restricting portion 150 is driven by the drive source 140.

The restricting portion 150 is supported by the housing 110 of the lock device 11 so as to pivot around a pivoting shaft 151, and is biased in a biasing direction D11 by a biasing portion 152. For example, the biasing portion 152 is an elastic member such as a coil spring, and is inserted in the pivoting shaft 151. One end of the biasing portion 152 is engaged with the restricting portion 150, and the other end is engaged with the housing 110 of the lock device 11. It is noted that as described below, the biasing direction D11 (an example of the second pivoting direction) is opposite to a pivoting direction D22 (an example of the first pivoting direction) in which the restricting portion 150 is driven by the drive source 140.

The restricting portion 150 includes a pressing portion 153, an opening portion 154, and an engaging portion 155. The pressing portion 153, in conjunction with an operation of the drive source 140 to release the engagement between the restricting portion 150 and the lock cover 111, presses the engaging portion 161 of the lock cover 111 in an opening direction D31 in which the lock cover 111 is opened, and thereby the lock cover 111 is automatically opened.

The opening portion 154 has an opening that is pierced by the shaft portion 143 of the movable portion 141, and the diameter of the opening is larger than the outer diameter of the shaft portion 143. A linear movement of the movable portion 141 of the drive source 140 is converted through the shaft portion 143 and the opening portion 154 to a rotational movement of the restricting portion 150.

The engaging portion 155 has a shape of letter "L", and its contact surface 156 at its tip, faces and abuts on the contact surface 162 of the engaging portion 161 of the lock cover 111. This allows the engaging portion 155 to be engaged with the engaging portion 161 of the lock cover 111, and restricts the lock cover 111 from being opened.

Specifically, the engaging portion 155 and the engaging portion 161 constitute a snap-fit mechanism in which, as the engaging portion 161 is inserted toward the engaging portion 155, they contact, and one or both of them are bent and then recovered so that they are engaged with each other, thereby restricting the engaging portion 155 and the engaging portion 161 from being separated from each other.

The regulating portion 160, in the housing 110 of the lock devices 11, regulates the pivoting of the lock cover 111 at a predetermined position when the lock cover 111 is biased by the biasing portion 152 in the biasing direction D11.

In the lock devices 11, the drive source 140 is controlled by the control portion 9 such that, as shown in FIG. 7 to FIG. 10, the lock cover 111 is unlocked by the lock mechanism 112 and the lock cover 111 is opened. It is noted that the control portion 9 may cause the lock mechanism 112 to unlock the lock cover 111 at a predetermined arbitrary timing. For example, the control portion 9 may unlock when the front cover 10A is opened in a state where the remaining amount or used amount of developer of any of the developer storing portions 101 has reached the threshold.

Specifically, in the state where the lock cover 111 is closed, as shown in FIG. 7, the lock cover 111 is in a locked state where the engaging portion 161 of the lock cover 111 and the engaging portion 151 of the restricting portion 150 are engaged with each other, and the lock cover 111 is restricted from being opened.

Figure 8:
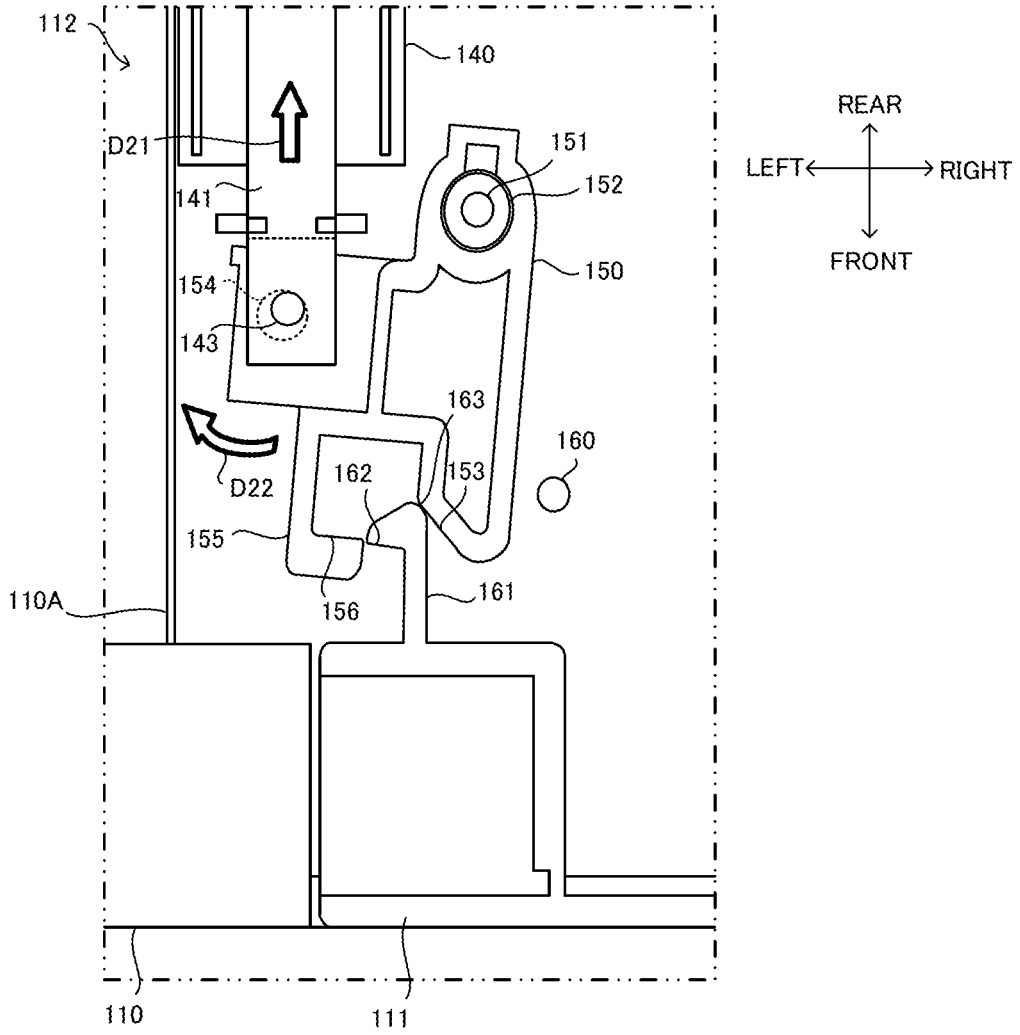
FIG. 8 is a diagram showing a state transfer of the lock device according to the embodiment.

As shown in FIG. 8, when the drive source 140 is driven by the control portion 9, the movable portion 141 is sucked and drawn in the suction direction D21, and in conjunction with this, the restricting portion 150 pivots around the pivoting shaft 151 in the pivoting direction D22.

With the above-described operation, the engagement between the engaging portion 155 and the engaging portion 161 is released, and the engaging portion 161 becomes capable of moving forward. In addition, at a predetermined timing while the restricting portion 150 is pivoting, the pressing portion 153 of the restricting portion 150 comes into contact with the tip portion 163 of the engaging portion 161 of the lock cover 111.

Figure 9:
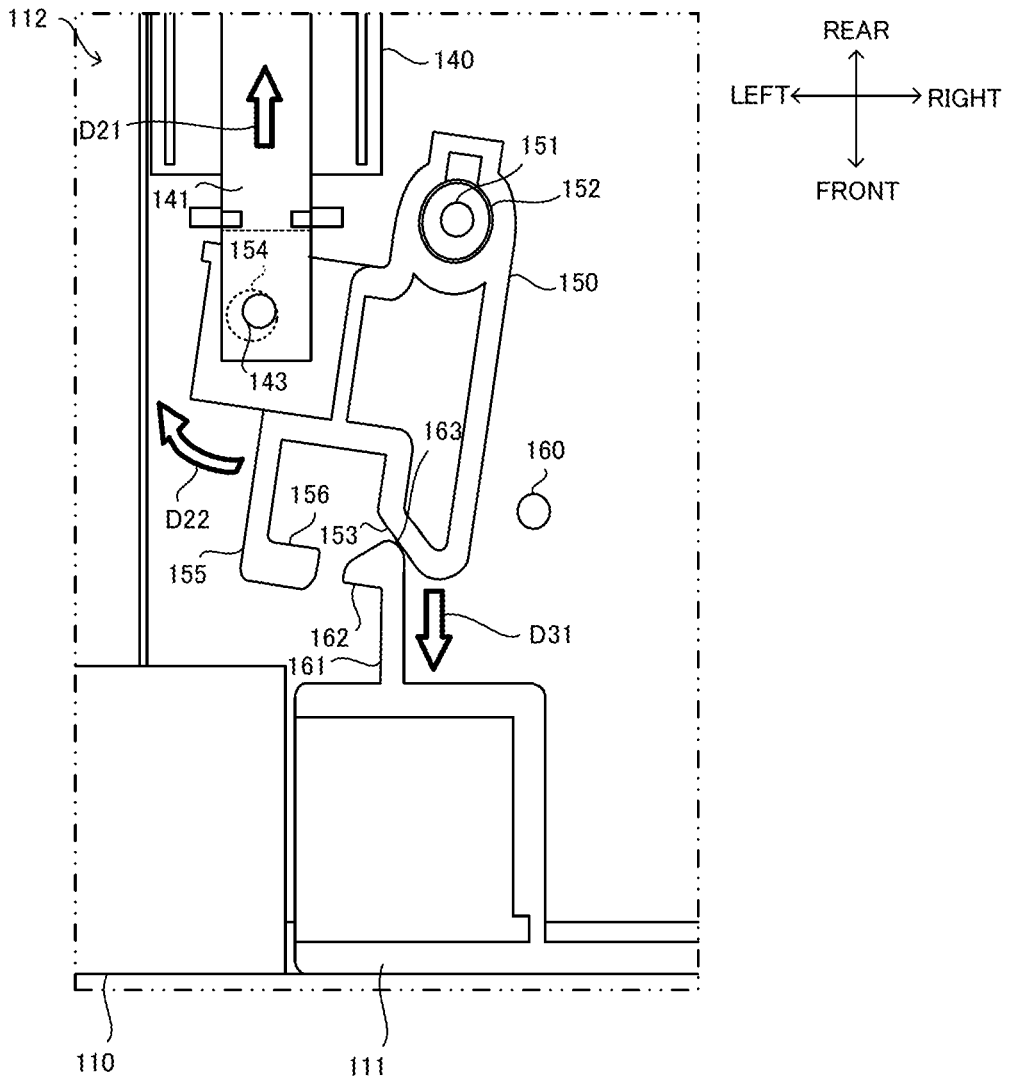
FIG. 9 is a diagram showing a state transfer of the lock device according to the embodiment.

Subsequently, as shown in FIG. 9, when the movable portion 141 is further drawn in the suction direction D21 and the restricting portion 150 further pivots in the pivoting direction D22, the pressing portion 153 of the restricting portion 150 presses the tip portion 163 of the engaging portion 161 of the lock cover 111 toward the front side.

Here, the positions and shapes of the engaging portion 155, the engaging portion 161, the pressing portion 153, and the tip portion 163 are determined such that the timing at which the engagement between the engaging portion 155 and the engaging portion 161 is released is equal to or earlier than the timing at which the pressing portion 153 and the tip portion 163 come into contact with each other. Accordingly, when the tip portion 163 of the engaging portion 161 is pressed by the pressing portion 153, the lock cover 111 pivots around the pivoting shaft provided in a lower end portion thereof, and is opened automatically (see FIG. 11).

Figure 10:
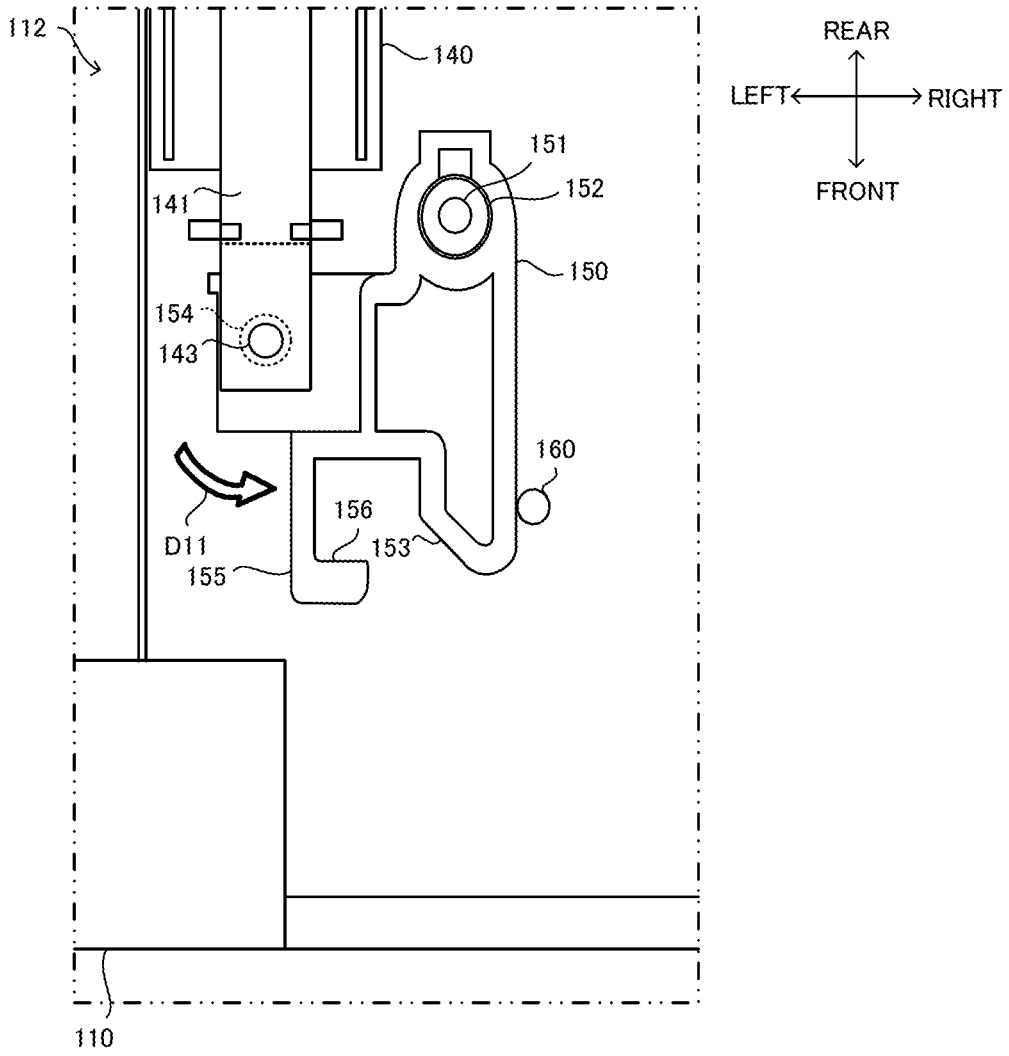
FIG. 10 is a diagram showing a state transfer of the lock device according to the embodiment.
Figure 11:
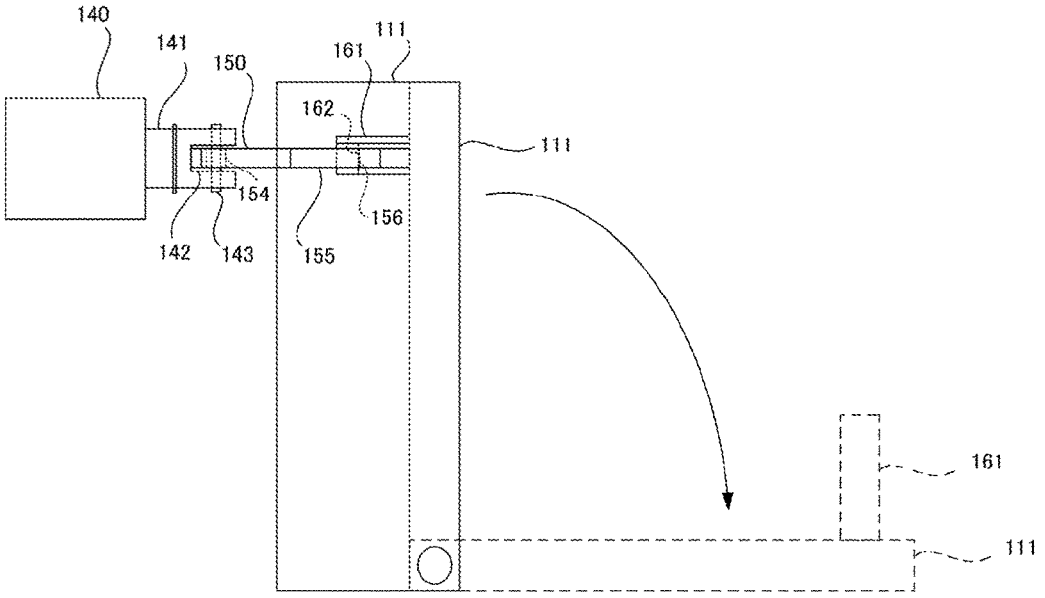
FIG. 11 is a diagram showing a state transfer of the lock device according to the embodiment.

As shown in FIG. 10, when the lock cover 111 is opened, the restricting portion 150 is pivoted, by a biasing force applied by the biasing portion 152, in the biasing direction D11 to a position where the pivoting is regulated by the regulating portion 160. With this configuration, when the lock cover 111 is closed next time, the engaging portion 161 of the lock cover 111 is engaged with the engaging portion 155 and the lock cover 111 is restricted from being opened (see FIG. 7).

As described above, in the lock devices 11, when the drive source 140 drives the restricting portion 150 to pivot, the lock cover 111 is unlocked, and in conjunction with this, the lock cover 111 is opened automatically. This enables the user to attach or detach a desired developer storing portion 101 without performing the work of opening the lock cover 111. In addition, the above-described configuration enables the user to determine clearly and easily that, among the four lock covers 111 corresponding to the four developer storing portions 101, a lock cover 111 that has been opened automatically is the lock cover 111 that corresponds to the work-target developer storing portion 101.

In addition, in the image forming apparatus 100, as described above, the front cover 10A is provided outside the lock covers 111 of the lock devices 11. Both the front cover 10A and the lock covers 111 that are provided on the inner side of the front cover 10A, are pivotally supported by pivoting shafts that are provided in the lower end portions thereof respectively, and are opened and closed by pivoting in the same direction. In view of this, a rib (not shown) may be provided on the rear-side surface of the front cover 10A such that when the front cover 10A is closed in a state where the lock covers 111 are opened, the rib abuts on the front surfaces of the lock covers 111. With this configuration, when the front cover 10A is closed in a state where the lock covers 111 are opened, the rib of the front cover 10A closes the lock covers 111. Accordingly, even in a state where one or more lock covers 111 are opened, the user can close the lock covers 111 only by closing the front cover 10A. This eliminates the trouble of attaching and detaching the developer storing portions 101.

Meanwhile, in the image forming apparatus 100, there is a possibility that, in a locked state where a lock cover 111 is restricted by the lock mechanism 112 from being opened, the user may break open the lock cover 111 by forcefully pulling the lock cover 111. On the other hand, the image forming apparatus 100 restricts the lock cover 111 in the locked state from being broken opened, the lock cover 111 being opened and closed when the developer storing portion 101 is attached or detached.

Figure 13:
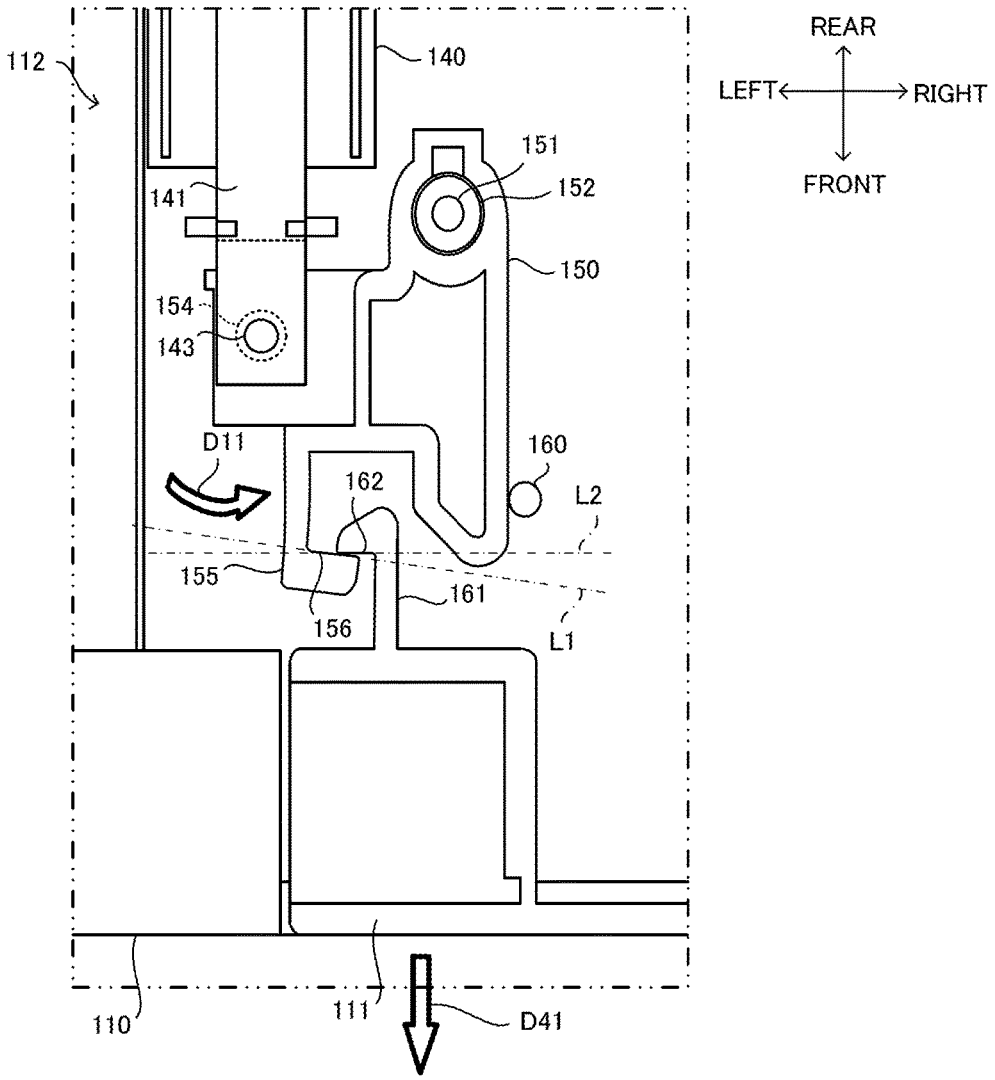
FIG. 13 is a diagram showing a comparative example of the lock device according to the embodiment.

Here, first suppose, as a comparative example, a configuration where, in the state where the lock covers 111 are closed and the engaging portion 161 and the engaging portion 155 are engaged with each other, an extension line L1 of the contact surface 156 and an extension line L2 of the contact surface 162 are parallel to each other. Specifically, an angle inside the L-shape portion of the contact surface 162 of the engaging portion 161, and an angle inside the L-shape portion of the contact surface 156 of the engaging portion 155 are each 90 degrees. In this case, as shown in FIG. 13, when an upper portion of a lock cover 111 is pulled by the user in a break-open direction D41 directed to the front side, the engaging portion 155 is bent leftward as the engaging portion 161 is displaced frontward, and the contact surface 156 of the engaging portion 155 is inclined. This causes the tip of the engaging portion 161 to be likely to move rightward along the contact surface 156, and the engagement between the engaging portion 155 and the engaging portion 161 to be likely to be released.

On the other hand, as shown in FIG. 7, according to the lock devices 11 of the present embodiment, the angle inside the L-shape portion of the contact surface 162 of the engaging portion 161 is greater than at least 90 degrees, whereas the angle inside the L-shape portion of the contact surface 156 of the engaging portion 155 of the restricting portion 150 is 90 degrees. That is, as shown in FIG. 7, in the state where the lock covers 111 are closed, and the engaging portion 161 and the engaging portion 155 are engaged with each other, the extension line L1 of the contact surface 156 and the extension line L2 of the contact surface 162 are not parallel. It is noted that the angle inside the L-shape portion of the contact surface 156 may be smaller than 90 degrees.

Figure 12:
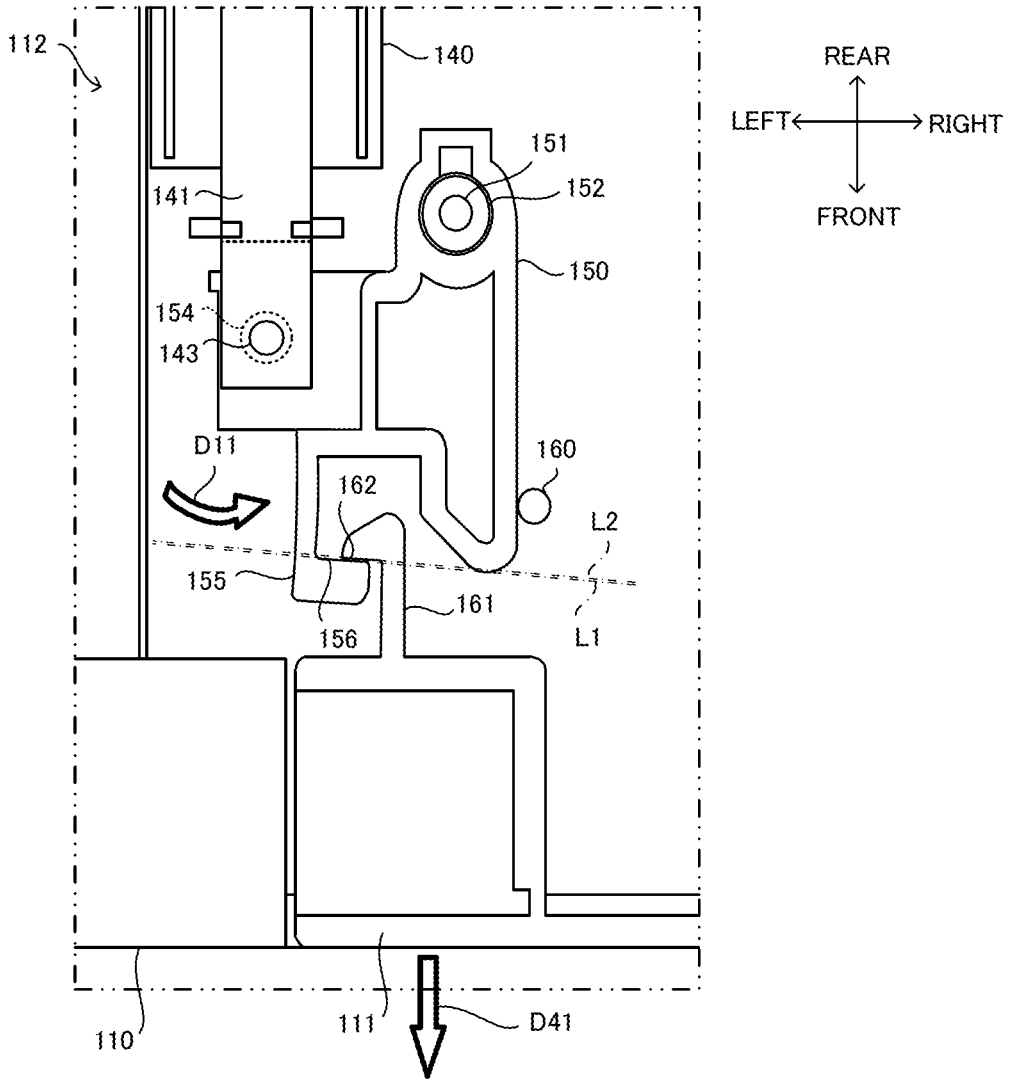
FIG. 12 is a diagram showing the lock device according to the embodiment.

In the lock devices 11, when an upper portion of a lock cover 111 is pulled by the user in the break-open direction D41 directed to the front side, as shown in FIG. 12, the engaging portion 155 is bent leftward as the engaging portion 161 is displaced frontward, and the contact surface 156 of the engaging portion 155 is inclined. As a result, when the upper portion of the lock cover 111 is pulled by the user in the break-open direction D41 directed to the front side, the extension line L1 of the contact surface 156 and the extension line L2 of the contact surface 162 become parallel at some timing. With this configuration, in the lock devices 11, when the engaging portion 155 is bent, the engaging portion 155 draws the engaging portion 161 to the inside with a stronger force. Accordingly, this makes it possible to prevent the lock cover 111 from being broken opened.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A lock device comprising:

a lock cover configured to be opened and closed when a developer storing portion storing developer is attached or detached;

a restricting portion configured to, when the lock cover is closed, be engaged with the lock cover in such a way as to restrict the lock cover from being opened;

a drive source configured to drive the restricting portion in such a way as to release an engagement between the restricting portion and the lock cover;

a biasing member configured to bias the restricting portion in a direction opposite to a direction in which the drive source drives the restricting portion; and a pressing portion configured to press the lock cover in an opening direction in conjunction with an operation of the drive source to release the engagement between the restricting portion and the lock cover, wherein each of the lock cover and the restricting portion includes an engaging portion that has a contact surface, and when the lock cover is closed, the contact surfaces of the lock cover and the restricting portion are engaged with each other while facing each other, and the contact surfaces of the lock cover and the restricting portion are not parallel to each other in a state where the lock cover is closed, and as the lock cover is displaced in the opening direction of the lock cover when the drive source is not driving the restricting portion, one or both of the engaging portions are bent and the contact surfaces become parallel to each other.

2. The lock device according to claim 1, wherein the drive source is a solenoid and, in response to energization, moves a movable portion in a predetermined direction, the restricting portion is coupled with the movable portion, and pivots in a first pivoting direction in conjunction with a movement of the movable portion in the predetermined direction, the biasing member is a coil spring and biases the restricting portion in a second pivoting direction that is opposite to the first pivoting direction, and the pressing portion is provided in the restricting portion.

3. An image forming apparatus comprising:

one or more of the lock devices according to claim 1; and an image forming portion configured to form an image by using developer stored in one or more developer storing portions that respectively correspond to the one or more of the lock devices.

4. The image forming apparatus according to claim 3, further comprising:

a front cover that is provided outside the lock covers of the lock devices, and is configured to be opened and closed, wherein the lock covers and the front cover are opened and closed by pivoting in a same direction, and the front cover comes into contact with and closes the lock covers when the front cover is closed in a state where one or more of the lock covers are opened.

5. The image forming apparatus according to claim 4, further comprising:

a developer detecting portion configured to detect a remaining amount or used amount of developer in each of the one or more developer storing portions; and an open/close detecting portion configured to detect whether the front cover is opened or closed, wherein when the open/close detecting portion detects that the front cover is opened in a state where the remaining amount or used amount of developer of any of the one or more developer storing portions has reached a predetermined threshold, the drive source is driven and an engagement between the restricting portion and the lock cover that correspond to the developer storing portion whose remaining amount or used amount of developer has reached the threshold, is released.

6. A lock unit attached, in a detachable manner, to an image forming apparatus that includes an image forming portion configured to form an image by using developer of a plurality of colors stored in a plurality of developer storing portions, the lock unit comprising:

a plurality of the lock devices according to claim 1.

* * * * *